United States Patent [19]

Magee

[11] Patent Number: 4,856,784

[45] Date of Patent: Aug. 15, 1989

[54] CASINO GAME

[76] Inventor: Lillian K. Magee, 225 Grand Ave., Billings, Mont. 59101

[21] Appl. No.: 286,043

[22] Filed: Dec. 19, 1988

Related U.S. Application Data

[63] Continuation-in-part of Ser. No. 9,830, Feb. 2, 1987, abandoned.

[51] Int. Cl.[4] ..... A63F 5/04

[52] U.S. Cl. ..... 273/147; 273/146

[58] Field of Search ..... 273/146, 147

[56] References Cited

U.S. PATENT DOCUMENTS

| | | | |
|---|---|---|---|
| 1,464,019 | 8/1923 | Wenzel | 273/146 |
| 1,506,014 | 8/1924 | Lindsay | 273/146 X |
| 1,587,580 | 6/1926 | Dutton | 273/146 |
| 2,070,608 | 2/1937 | Mitchell | 273/146 |
| 3,799,554 | 3/1974 | Simons | 273/146 |
| 4,516,776 | 5/1985 | Nicholas | 273/146 |

FOREIGN PATENT DOCUMENTS

| | | | |
|---|---|---|---|
| 184750 | 8/1922 | United Kingdom | 273/147 |
| 400454 | 10/1933 | United Kingdom | 273/147 |
| 637247 | 5/1950 | United Kingdom | 273/146 |
| 803600 | 10/1958 | United Kingdom | 273/147 |

OTHER PUBLICATIONS

Culin, Chess and Playing Cards, 1898, pp. 822, 820, 831 & 832.

Depew, The Cokesbury Game Book, ©1939, p. 171.

Scarne, Scarne's Encyclopedia of Games, ©1973, pp. 454, 559, 560.

*Primary Examiner*—Paul E. Shapiro

[57] ABSTRACT

A casino type game includes a plurality of distinguishable sets of playing pieces with a multiplicity of pieces in each set. A spinnable unitary solid brass top member includes a central section including an even number and at least four faces disposed around the periphery thereof with uniform angularity between adjoining faces and opposite faces being substantially parallel. Each face of the central section is inscribed with a legend of "put", "take" or "lose spin" and different legends are on adjoining faces. A tapered pointed section is at one end of the central section. Cylindrical gripping mechanism extends axially from an opposite end of the central section remote from the pointed section. A shiny tightly adherent uniform continuous precious metal coating is over the exterior surface of the top member.

5 Claims, 1 Drawing Sheet

CASINO GAME

This application is a continuation-in-part of pending U.S. application Ser. No. 9,830, filed Feb. 2, 1987, abandoned.

This invention relates to a novel game and more particularly relates to a new casino type game.

A large number of different games have been developed through the ages. The games include a multitude of variables. Some games require a high degree of physical coordination such as shuffleboard, croquet and the like. Other games require a high degree of mental capability such as bridge, chess and the like.

Games also may be classified according to their playing conditions such as a table, an outdoor area, etc. Games may be further differentiated by the ages of the players. Another criteria may be the type of equipment needed such as a deck of cards, a playing board or the like. In addition, the classification may be whether the game provides educational benefits, relaxation, physical exercise, etc.

Because of the various criteria involved in producing a successful games, a very large number of different games have been proposed in the past and many new games are developed each year. Some of these games are offered to fill a specific interest void in available games. Others are derivatives of a popular game in an attempt to gain a share of the other game's market.

With the development of computers, there has been great interest in games that utilize this technology. In addition to games that can be played on home computers, sophisticated machines have been developed for commercial use in video arcades and similar facilities. Computer based machines also are being used for gambling in the market formerly held exclusively by slot machines. Computer programs now are available for playing traditional casino games such as poker, blackjack and the like.

Although computer games have become very popular, they still are not preferred by many people. Computers and machines based thereon may be intimidating to some older individuals. Also, the major investment in a home computer or the cost of playing commercial machines including computers may exceed the price people are willing to pay for such entertainment.

From the above discussion, it is clear that present games do not satisfy the desires and requirements of a significant number of persons. Thus, there is a need for new games to meet this market.

The present invention provides a novel game with a unique combination of features and advantages not found in previous games. The game of the invention satisfies the desire of people for an adult game which is similar to conventional casino games. In addition, the game can be played by one or more players with a minimum investment. Also, the game does not utilize complex mechanisms, devices and/or rules that require special attention and concentration on the part of the players.

The game can be played in a wide variety of circumstances and situations in which people find themselves. The game can be played in limited time periods and space since it does not require significant time or space to set up and play.

The game of the invention can be adapted to simplify the playing thereof by novices or conversely can be made more challenging for persons with considerable casino game experience. Thus, the game can be played by novices without feeling overwhelmed by the rules. Conversely, the rules of the game can be amplified to provide a high level of challenge for more experienced and knowledgeable persons so their interest in the game is maintained and they will not become bored.

The equipment for the game, although simple in design, includes protection against cheating and still can be produced relatively inexpensively. Commercially available materials and components can be utilized in the manufacture thereof as well as conventional fabrication methods.

These and other benefits and advantages of the novel game of the present invention will be apparent from the following description and the accompanying drawings in which.

Figure 1:
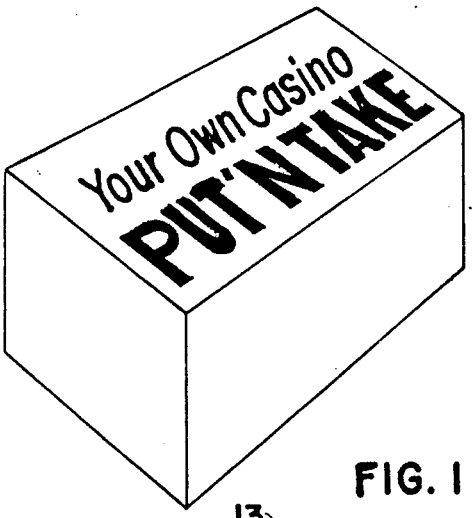
FIG. 1 is a view in perspective of the game of the invention.
Figure 2:
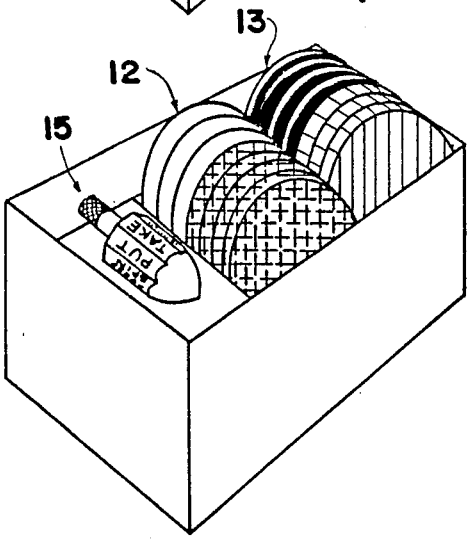
FIG. 2 is an enlarged side view of the top member of the game of the invention.

As shown in the drawings, one form of the novel game of the present invention includes a plurality of distinguishable sets of playing pieces shown as poker chips 12 an 13. The chips ordinarily are distinguishable by their respective colors. Alternatively, other playing pieces such as different color toothpicks, matches, coins or other game tokens may be utilized.

The game of the invention also includes a spinnable unitary solid brass top member 15. The top member 15 as shown includes a central section 16. The central section includes an even number of faces 17. The faces are disposed around the periphery of the central section. The faces are oriented with respect to one another to provide uniform angularity between adjoining faces. Opposite faces, e.g., faces 18 and 19 (FIG. 4) are disposed substantially parallel to one another.

With this arrangement of faces of the central section, six faces will form a central section with a hexagonal cross section. Similarly, a central section with eight faces will form an octagonal cross section.

Figure 3:
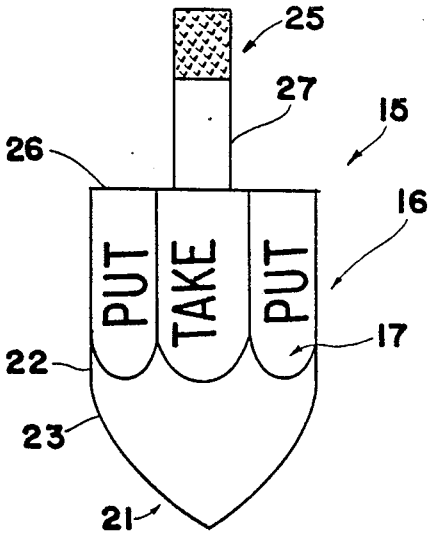
FIG. 3 is a sequence of legends arranged around the periphery of the top member of the game of the invention shown in FIGS. 1 and 2.
Figure 3:
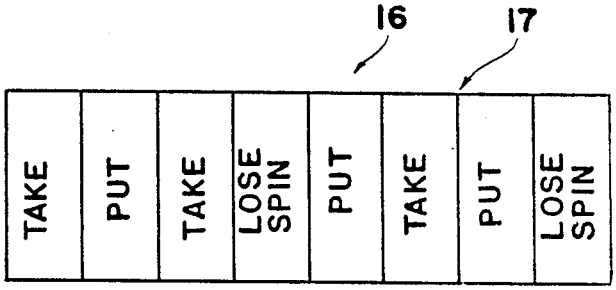

Each face of top member 15 is inscribed with one of the following legends: "put", "take" or "lose spin" and different legends on adjoining faces. FIG. 3 illustrates a sequence of legends for a top member with eight faces. If desired, the sequence of legends can be in a different order or wording added to further define the action to be taken as will be explained hereinafter. Also, the legends can be logos rather than words and can be in a foreign language instead of English.

The top member 15 further includes a pointed section 21. The pointed section is located at one end 22 of the central section. The pointed section includes a section 23 tapering to a point as shown.

Cylindrical gripping means 25 extend axially from an opposite end 26 of the central section 16. End 26 is remote from the pointed section 21. The gripping means 25 as shown preferably includes a knurled section 27, although other similar means may be utilized.

The top member 15 of the game of the invention is a unitary solid brass top member. Such a solid hard unitary structure minimizes the possibility of tampering of the top member to influence the side on which the top falls and thereby the opposite upward face to a desirable legend.

Additional protection against tampering on the top member is achieved by facilitating detection of the tampering. This is accomplished by providing a shiny tightly adherent uniform continuous precious metal coating, advantageously gold plating, over the exterior surface of the top member 15. The thin precious metal coating bestows the top member with a shiny smooth uniform surface appearance.

Scarne's Encyclopedia of Games, 1973, pages 560 (cited by the Examiner in the parent application) suggests that cheating can be done by rounding some edges of the central section. Tampering also may involve drilling holes into the top, inserting a heavier density plug and covering the exterior surface.

Should there be any such tampering, the removal therewith of any part of the shiny smooth uniform continuous precious metal coating on the top surface is easily detected by the disruption of the shiny surface and the exposure of the dull surface of the underlying brass. Even repair of the gold plating is easily detected as unevenness of the shiny smooth uniform appearance of the original coating.

Although it is impossible to completely eliminate attempts at cheating, the top member of the invention minimizes tampering since to be successful it would be necessary to remove the entire original precious metal coating and replate the brass top or instead to completely fabricate a new top member.

Figure 4:
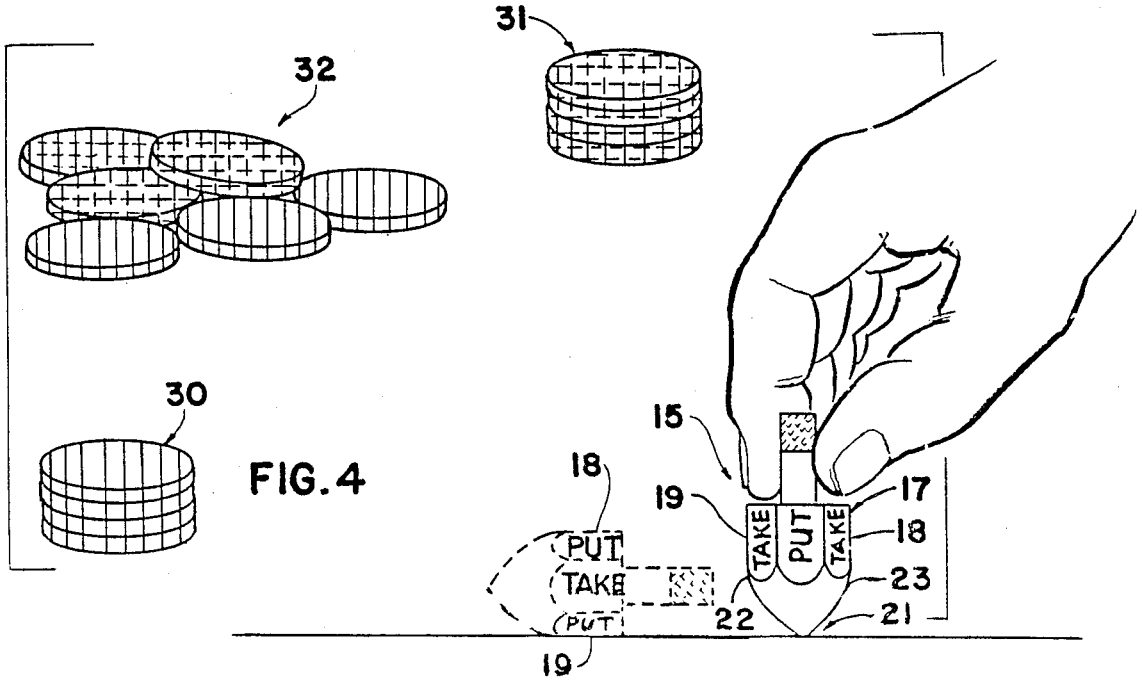
FIG. 4 is a schematic illustration of an arrangement of devices of the game of the invention during the playing of the game.

In the playing of the game of the invention as shown in FIG. 4 and as described above, each player first selects a distinguishable set of playing pieces shown as stacks 30 and 31. Thereafter, one of the players is selected to commence play. This may be accomplished by agreement or more advantageously by the players in turn spinning the top member.

The players can agree in advance that whoever spins a particular legend e.g. "take" will be the first player. If more than one player spins "take" in the first turn, then those players take additional turns until only one survives and that person starts the game.

The first player spins the top member between a thumb and forefinger. After the top member is rotating at the desired speed, pressure on the knurled section 27 is relaxed, freeing the top to continue spinning on a flat base surface such as a table top. Spinning time can be decreased by spinning on a softer surface such as a paper or cloth napkin, tablecloth, or the like.

The top member 15 will continue to spin on its pointed section 21 with each revolution slightly slower until the top member no longer can balance on the pointed section. At that time, the top member will topple over and come to rest on a face 19 of the central section 16.

In this orientation, another face 18 of the central section extends upwardly opposite to that face 19 on which the top member rests. This upward face 18 is visible to all players so they can observe the action to be taken by the players. If the legend is "put", each player antes an equal number of playing pieces shown as chips into a central pot 32. If instead, the upward legend is "take", the person who has spun the top member takes the playing pieces that have collected in the pot.

When either the legent "put" or "take" is spun, after the appropriate chip transfr is completed, the same player has another turn to spin the top member. This procedure is repeated with the same player continuing to spin the top member until the upward legend is "lose spin". At that point, the top member is passed to the next player who repeats the same steps.

Play is continued with each succeeding player until the game is completed. This ordinarily will occur when one player has collected all of the playing pieces. Alternatively, the players can agree in advance to a different termination.

For example, the players can agree to a specific playing time period after which each player counts his chips and the player with the most chips is the winner. The game also can terminate after a preselected number of spinning turns for each player, the player with the most chips being the winner.

EXAMPLE

One set of rules includes the following:

1. Each player chooses his stack of playing chips of his own color.
2. Each player is given one spin of the top. The player who comes up with "take" will have control of the top.
3. The player who has control of the top will retain control of the top until the top comes up "lose spin".
4. The top then is passed to the next player in clockwise fashion.
5. To begin the game, each player antes the same amount of chips.
6. The chips are placed in the central or pot position.
7. The person in control of the top spins the top. Should the word "put" come up, each player antes an additional chip or chips. This action includes the player in control of the top.
8. The person in control of the top spins the top again. Should the work "take" come up, the person in control of the top takes all of the chips in the pot.
9. For the next move, the person in control of the top spins the top again.
10. The action continues as above until the words "lose spin" come up. The top then is passed to the next player in clockwise fashion and he spins the top.

The rules of the game of the invention can be supplemented or modified with the ideas of the players, if desired. Typical changes include variations in the number of chips anted or taken from the pot for particular spins and/or legends. Also, the players can divide into teams with members rotating the team's spins. One person can play the game by assigning different spins to each assumed player.

The above description and the accompanying drawings show that the present invention provides a novel game with features and advantages not found in earlier games. The game of the invention does not utilize complicated mechanisms, devices and/or rules and thus the game is relatively inexpensive. The game is compact in size and can be carried easily in a pocket, purse, briefcase, etc. The game is suitable for play in a variety of circumstances such as on planes, in cars and similar situations away from a game table in a home.

The game can be played in a short period of time if desired. The game can be played by novices or persons with considerable experience in casino games. It will not overwhelm novices but still can offer a challenge for more experienced players.

The devices employed in the game are simple in design, durable in construction and provide protection against cheating. The game is not a fad but is timeless.

It will be apparent that various modifications can be made in the particular game described in detail above and shown in the drawings within the scope of the invention. The size and configuration of the devices can be different. Thus, the top member can be modified to spin in another way and still select one legend from a group. Also, the arrangement of the legends can be changed to include or delete particular actions. Playing pieces available at the playing site can be substituted. These and other changes can be made in the game of the invention provided the functioning and operation thereof are not adversely affected. Therefore, the scope of the present invention is to be limited only by the following claims.

What is claimed is:

1. A casino type game including a plurality of distinguishable sets of playing pieces with a multiplicity of pieces in each set; a spinnable unitary solid brass top member, said top member including a central section including an even number and at least four faces disposed around the periphery thereof with uniform angularity between adjoining faces and opposite faces being substantially parallel, each face of said central section being inscribed with a legend of "put", "take" or "lose spin" and different legends on adjoining faces, a tapered pointed section at one end of said central section and cylindrical gripping means extending axially from an opposite end of said central section remote from said pointed section, and a shiny tightly adherent uniform continuous metal coating over the exterior surface of said top member.

2. A casino type game according to claim 1 wherein said playing pieces are chips.

3. A casino type game according to claim 1 wherein said central section of said top member includes eight faces.

4. A casino type game according to claim 1 wherein said gripping means of said top member includes a knurled section.

5. A casino type game according to claim 1 wherein said metal coating on said top member is gold plating.

* * * * *